US005870014A

United States Patent [19]

Nield, Jr. et al.

[11] Patent Number: 5,870,014

[45] Date of Patent: Feb. 9, 1999

[54] THERMALLY ACTUATABLE AUXILIARY ELECTRICAL SWITCH APPARATUS

[75] Inventors: Joseph G. Nield, Jr., North Smithfield, R.I.; James T. Racine, Lake in the Hills, Ill.; Alfred Raulino, Attleboro, Mass.

[73] Assignee: Texas Instruments Incorporated, Dallas, Tex.

[21] Appl. No.: 729,606

[22] Filed: Oct. 11, 1996

[51] Int. Cl.[6] ..... H01H 37/52; H01H 37/04

[52] U.S. Cl. ..... 337/362; 337/333; 337/372; 337/380

[58] Field of Search ..... 337/85, 89, 97, 337/100, 101, 102, 112, 333, 342, 343, 377, 379, 380, 349, 56; 361/103, 105, 31, 32; 318/783, 778, 767

[56] References Cited

U.S. PATENT DOCUMENTS

| | | | |
|---|---|---|---|
| 3,146,378 | 8/1964 | Grenier . | |
| 3,213,239 | 10/1965 | Bodge . | |
| 3,521,138 | 7/1970 | Enemark et al. | 337/102 X |
| 3,803,525 | 4/1974 | Bickmire et al. | 337/104 |
| 3,818,404 | 6/1974 | Senor et al. | 337/85 |
| 3,936,792 | 2/1976 | Senor et al. . | |
| 4,177,443 | 12/1979 | Willeke | 337/377 X |
| 4,297,668 | 10/1981 | Place | 337/377 X |

FOREIGN PATENT DOCUMENTS

| | | |
|---|---|---|
| 0430662 | 5/1991 | European Pat. Off. . |
| 1526932 | 12/1968 | France . |
| 2136217 | 12/1984 | United Kingdom . |

*Primary Examiner*—Leo P. Picard
*Assistant Examiner*—Anatoly Vortman
*Attorney, Agent, or Firm*—Russell E. Baumann; Richard L. Donaldson; René E. Grossman

[57] ABSTRACT

A thermally actuatable auxiliary switch (10, 10', 100) used with a refrigerator compressor system (60) has a generally U-shaped bimetallic element (12) mounted at one end on a base plate (16, 16', 102) and with a movable contact (28) mounted on the high expansion side (12*a*) of the bimetallic element in alignment with a stationary contact (32) mounted on a stationary contact support (18, 18', 116). A thermal generator (34) in the form of a PTC pill (36) wire-wound resistor (28), or other electrically energizable heater or in the form of a discharge tube (60*e*) of a compressor, provides heat to the bimetallic element (12) causing it to deflect after the solid state starter (50) has switched to its high resistance state to switch out the solid state starter while the compressor motor remains energized.

2 Claims, 4 Drawing Sheets

THERMALLY ACTUATABLE AUXILIARY ELECTRICAL SWITCH APPARATUS

FIELD OF THE INVENTION

This invention relates generally to electric motor starting and more specifically to apparatus for turning off a solid state motor starter after energization of the motor in order to conserve electrical energy.

BACKGROUND OF THE INVENTION

It is conventional to use solid state motor starting devices to start split phase electric motors. Such devices comprise a positive temperature coefficient of resistivity (PTC) element serially connected to the start winding of the motor. The PTC element has a low level of resistance upon energization allowing an inrush of current through the start winding. As the motor approaches running speed in approximately 0.5 to 1.0 second, the resistance of the PTC element greatly increases effectively de-energizing the start winding. The PTC element remains in the high resistance, energized state maintaining the start winding off until the motor is de-energized. Although this is effective in starting the motor, it results in a continuous expenditure of energy in keeping the PTC element energized. For example, when used with refrigerator compressor motors approximately 2–2.2 watts of energy are consumed whenever the compressor motor is running. This energy consumption is undesirable and considered to be wasted.

SUMMARY OF THE INVENTION

It is an object of the invention to provide apparatus which alleviates the above noted prior art problem. Another object of the invention is the provision of apparatus useful with a solid state motor starter which can minimize or even eliminate the expenditure of energy by the solid state motor starter once the motor is in the running condition.

Briefly, an auxiliary electrical switch made in accordance with the invention comprises an electrically conductive, generally U-shaped bimetallic blade having a high expansion layer on the outside and a first end mounted on an electrically conductive base plate. A movable contact is mounted on the high expansion layer at the second end aligned with, and at room temperature, in engagement with a stationary contact mounted on an electrically conductive stationary contact support. A thermal generator is disposed in heat conductive relationship with the bimetallic blade. The movable end stationary contacts are serially connected to the PTC element of the motor starter. In a first embodiment the thermal generator, in the form of a PTC pill, wire-wound resistor, composite resistor or the like, is disposed on the bimetallic blade and is electrically connected across the main winding of the motor. When the motor is energized the PTC element of the motor starter allows current to flow through the start winding and then switches to a high resistance state effectively shutting off the start winding as the motor reaches normal running speed in approximately 0.5 to 1.0 second. Current also passes through the thermal generator of the auxiliary switch causing the bimetallic element to deflect at a time following the resistance increase of the PTC element moving the movable contact away from the stationary contact of the auxiliary switch thereby de-energizing the PTC element of the motor starter. The auxiliary switch contacts remain open as long as the main winding is energized consuming a low level of power, on the order of 0.5 watts or less.

According to second and third embodiments, the auxiliary switch is thermally coupled to the discharge tube of a compressor which serves as the thermal generator. According to a feature of the embodiments, high pressure refrigerant gas being pumped through the compressor system provides heat energy through the discharge tube to raise the temperature of the bimetallic element to its actuation temperature to switch out the PTC element of the motor starter without the expenditure of further energy.

BRIEF DESCRIPTION OF THE DRAWINGS

Other objects, advantages and specific features of the novel and improved auxiliary electrical switch of this invention especially adapted for use with refrigeration motor compressor systems appear in the following detailed description of the preferred embodiments of the invention, the detailed description referring to the drawings in which.

DESCRIPTION OF THE PREFERRED EMBODIMENTS

Figure 1:
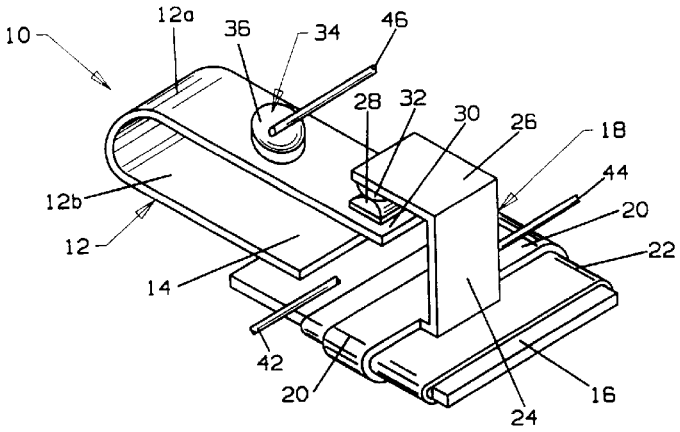
FIG. 1 is a perspective view of an auxiliary switch made in accordance with a first embodiment of the invention.
Figure 1A:
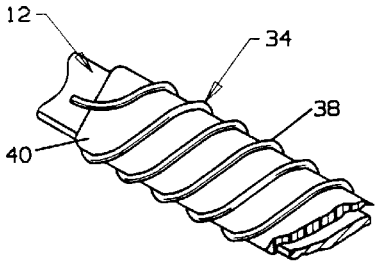
FIG. 1*a* is a perspective view of a portion of the bimetallic element showing a wire wound thermal generator thermally coupled thereto.

With reference to FIG. 1, a thermally actuatable, auxiliary electrical switch 10 made in accordance with the invention comprises a generally U-shaped creep type bimetallic element 12 having a first end 14 mounted to base plate 16. Bimetallic element 12 is electrically conductive and has a high expansion side 12*a* on the outside and a low expansion side 12*b* on the inside of the U-shaped configuration. End 14 is attached to base plate 16, formed of any suitable electrically conductive material such as a nickel zinc coated steel, as by welding. A stationary contact support 18, also of electrically conductive material which conveniently can be formed of the same material as that of base plate 16, has opposed leg portions 20 crimped onto both sides of base plate 16 with a layer 22 of suitable electrically insulative material such as NOMEX, a trademark of DuPont de Nemours & Co. for aramid paper, interposed between base plate 16 and legs 20. A leg 24 extends upwardly from base plate 16, as seen in FIG. 1, with a platform 26 extending transversely therefrom. A movable electrical contact 28 is mounted on the high expansion side 12*a* at a second end 30 of bimetallic element 12 aligned with a stationary electrical contact 32 on the surface of platform 26 facing base plate 16. A thermal generator 34 is mounted in heat transfer relation with bimetallic element 12 as by mounting it directly thereon intermediate its first and second end utilizing a thermally conductive epoxy. Thermal generator 34 can be a PTC pill 36 as shown in FIG. 1, a wire-wound resistor 38 shown wrapped around a layer of electrically insulative material 40 disposed on bimetallic element 12, as shown in FIG. 1*a*, a composite resistor or any other thermal generating component.

A first electrical lead 42 is connected to base plate 16 and a second electrical lead 44 is connected to stationary contact support 18 in any suitable manner, as by welding thereto. Electrical lead 46 is shown connected to one face surface of PTC pill 36 in a conventional manner with its opposite face surface electrically connected to bimetallic element 12. If desired, PTC pill 36 can be electrically isolated from element 12 and provided with a separate electrical lead for the opposite face surface.

The auxiliary switch can be calibrated for opening temperature by bending platform 26 of stationary contact support 18 toward and away from base plate 16.

Figure 2:
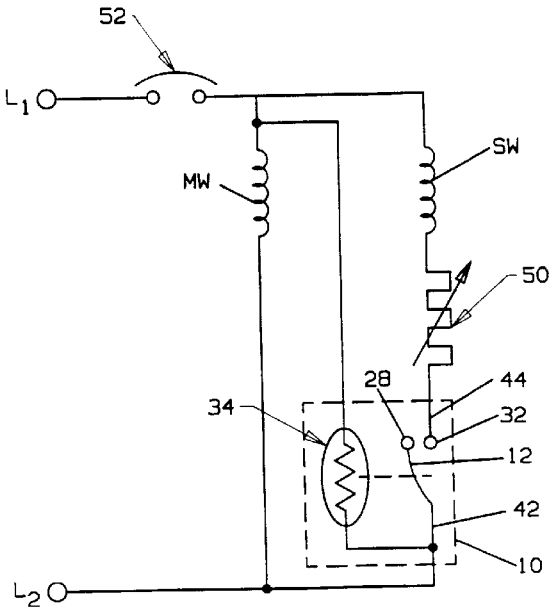
FIG. 2 is a schematic circuit diagram showing the auxiliary switch used with a starting device in a split-phase motor.

With reference to FIG. 2, auxiliary switch 10 is shown used with a split-phase motor comprising a main winding MW and start winding SW. A solid state motor starting device 50 comprising a PTC element is connected in series with start winding SW. Stationary contact 32 is serially connected to starting device 50 by means of lead 44 and movable contact 28 is connected to line $L_2$ by means of lead 42. Thermal generator 34 is connected across main winding MW, also connected across lines $L_1$, $L_2$. Typically a motor protector 52 is provided in line $L_1$.

At the time the motor is energized the PTC element of solid state starting device 50 is in a low resistance state allowing an inrush of current to flow through the start winding for a brief period of time, e.g., 0.5 to 1 second, to get the motor started and then switches to its high resistance state and effectively stops the flow of current through the start winding. Without the use of auxiliary switch 10, starter 50 remains energized in the high resistance state dissipating approximately 2–2.2 watts of energy. However, with auxiliary switch 10, the thermal generator 34 connected across the main winding starts to heat the bimetallic element 12 causing the bimetallic element to deflect at a time following the change in resistance of the starter 50 causing movable contact 28 to move out of engagement with stationary contact 32. This opens the circuit to the solid state motor starter maintaining it in the open condition as long as the main winding is energized. Once the motor is de-energized the auxiliary switch will cool and movable contact 28 will move back into engagement with stationary contact 32. When the motor is energized again the cycle described above will repeat itself. Thermal generator 34 is much smaller than the PTC element of solid state starter 50 consuming typically 0.3 to 0.5 watts.

Figure 3:
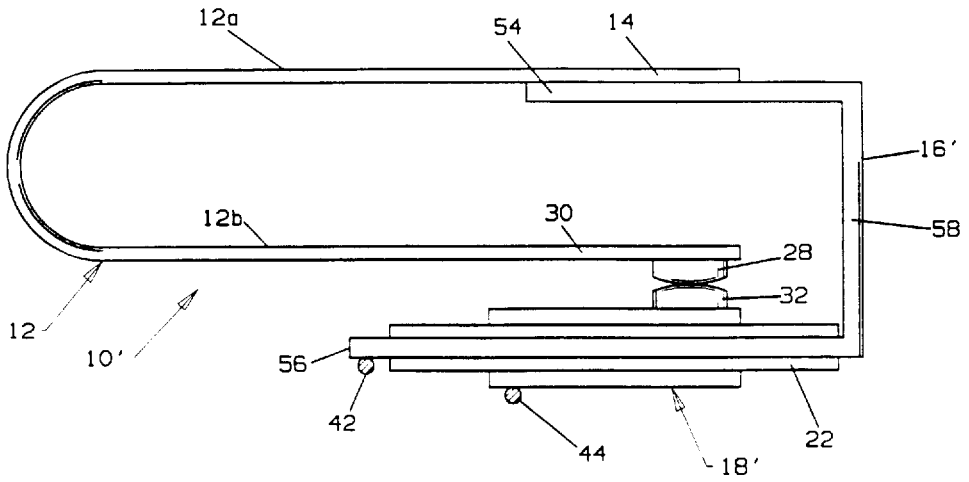
FIG. 3 is a front elevational view of an auxiliary switch made in accordance with a second embodiment of the invention.
Figure 4:
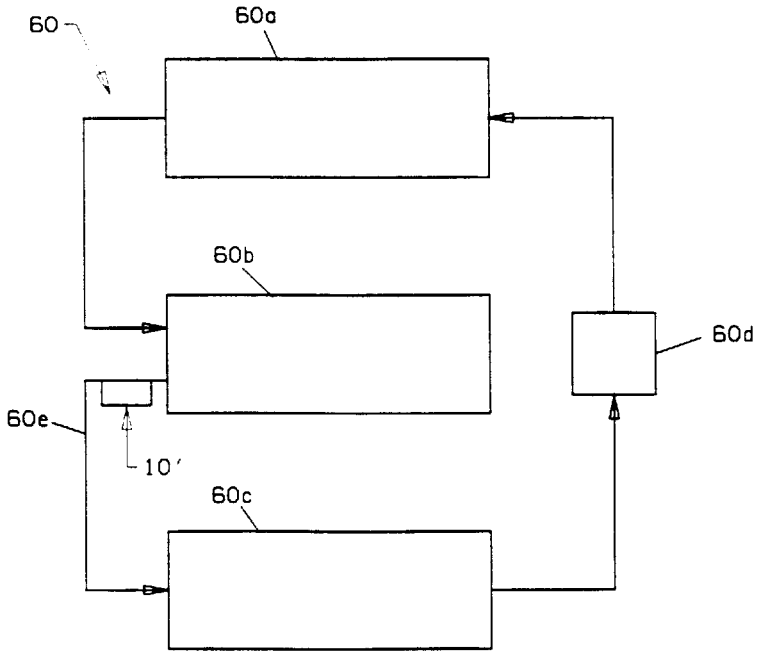
FIG. 4 is a block diagram of a refrigerator motor compressor system with which the FIG. 3 embodiment is used.

With respect to FIG. 3, a second embodiment of the invention is shown in which the entire power normally consumed by the solid state starter is conserved upon switching of the auxiliary switch 10'. As seen in the figure, generally U-shaped bimetallic element 12, which can be the same bimetallic element as that employed in the FIG. 1 embodiment, is mounted on and electrically connected to one leg 54 of a generally U-shaped base plate 16'. A stationary contact support 18' is crimped around second leg 56 of U-shaped base plate 16' with a layer 22 of electrically insulative material interposed therebetween. Layer 22 can be the same as that of the FIG. 1 embodiment. Movable contact 28, mounted on the high expansion side 12*a* of end 30 of bimetallic element 12 is aligned with and, at ambient temperature conditions, in engagement with stationary contact 32. Switch 10' is thermally coupled to the port of the discharge tube 60*e* of compressor system 60 shown in FIG. 4, electrically isolated from the tube, as by strapping bight portion 58 of base plate 16' thereto. As shown in FIG. 4, refrigerator compressor system 60 comprises an evaporator 60*a*, compressor 60*b*, condenser 60*c* and expansion valve 60*d* coupled together as indicated by the arrows with auxiliary switch 10' thermally coupled to discharge tube 60*e*.

At the time the circuit is closed in the refrigerator compressor system the solid state starter is in its low resistance state and allows current to flow through the start winding for approximately 0.5 to 1.0 second. The PTC element of the starter then switches to a high resistance state thereby decreasing current to a milliamp level, that is, effectively turning off the start winding. In this condition and without auxiliary switch 10', the PTC element of the solid state starter remains in the high resistance state dissipating approximately 2–2.2 watts the entire time that the compressor is running. However, with the auxiliary switch 10' mounted on the discharge tube the switch will disconnect the solid state starter from the circuit shortly after the compressor motor is energized, e.g., on the order of a few seconds for cycles following the initial cycle. The high pressure refrigerant gas being pumped through the compressor system causes the discharge tube to heat up so that the discharge tube serves as the thermal generator 34. The heat from the discharge tube is transferred to bimetallic element 12 raising its temperature to its actuation temperature to open contacts 28, 32 and switch out the solid state starter thereby saving the entire amount of energy, i.e., 2–2.2 watts, normally dissipated by the PTC element of the motor starter.

Figure 5:
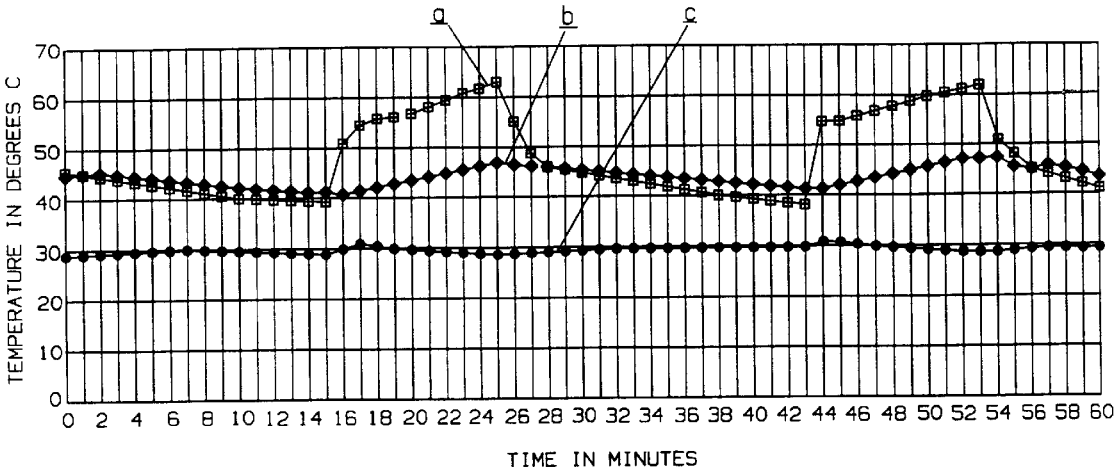
FIG. 5 is a graph showing the FIG. 4 refrigeration system temperature profile.

With reference to FIG. 5, a temperature profile of a refrigerator system employing an auxiliary switch made in accordance with the FIG. 3 embodiment is shown with curve a representing the temperature of the discharge tube, curve b the fusite header through which electrical connection to the system is made and curve c the temperature of the internal air of a housing mounting the motor starter and motor protector mounted on the fusite header. It will be seen that although the temperature excursion of the fusite header and the internal air is quite limited, the temperature level of the discharge tube cycles between approximately 38° C. and 62° C. as the compressor motor cycles between the unenergized and energized conditions under the control of a thermostat. A bimetallic element 12 formed of B1 material available from Texas Instruments Incorporated, 0.015 inch thick thermally coupled to discharge tube 60 opened the contacts each time the compressor motor was energized. Once the refrigerator thermostat shuts off the compressor the discharge tube cools allowing the thermally actuated bimetal element switch to close or reset ready for the next operating cycle of the compressor.

With reference to FIGS. 6–9, a modified embodiment is shown which uses discharge tube 60*e* as the heat generator as in the FIG. 3 embodiment. Auxiliary switch 100 comprises a generally U-shaped bimetallic element 12 which again can be the same element as that employed in the embodiments described above. Bimetallic element 12 has one end attached to base portion 102, as by welding with its second end mounting movable electrical contact 28. Base portion 102 is integrally formed with a terminal 104 which is mounted on a housing member 106 formed of suitable electrically insulative material. Terminal 104 has downwardly extending legs 108 which are received in a slot 110 of a sidewall of housing 106. Legs 108 are formed with a locking portion 112 bent out of the plane in which the legs 108 lie which interact with a ledge 114 of the sidewall of housing 106 to lock the terminal in place.

A stationary electrical contact support 116 is integrally formed with a second terminal 118 which is also provided with downwardly extending legs 120 for placement in another slot in a sidewall of housing 106 and is locked thereon using a corresponding locking portion 122. Stationary electrical contact 32 is attached to support 116 so that contacts 28, 32 are in alignment with one another.

A heat transfer member, spring clip 124 formed of material having good heat conductive and good spring characteristics, such as beryllium copper, has a pair of tube engaging arms 126 extending downwardly from a heat sink plate 128 therefrom and a pair of housing engaging arms 130 extending upwardly. Arms 130 each have a cut-out 132 arranged to fit over projections 131 formed in the sidewall of housing 106 to attach clip 124 thereto. Arms 126 are adapted for placement on discharge tube 60*e* and are preferably provided with a curved surface to increase the surface area of engagement with the discharge tube in order to enhance thermal coupling.

Housing 106 is formed with a cut-out 134 in bottom wall 136 so that leg 31 of bimetallic element 12 and heat sink plate 128 of clip 124 can be received therein for intimate thermal coupling with one another. Bimetallic element 12 and discharge tube 60*e* are electrically isolated from one another as by interposing a thin layer of electrically insulating material, such as Kapton, a trademark of DuPont de Nemours & Co. for polyimide (not shown) between heat sink plate 128 and leg 31.

Figure 6:
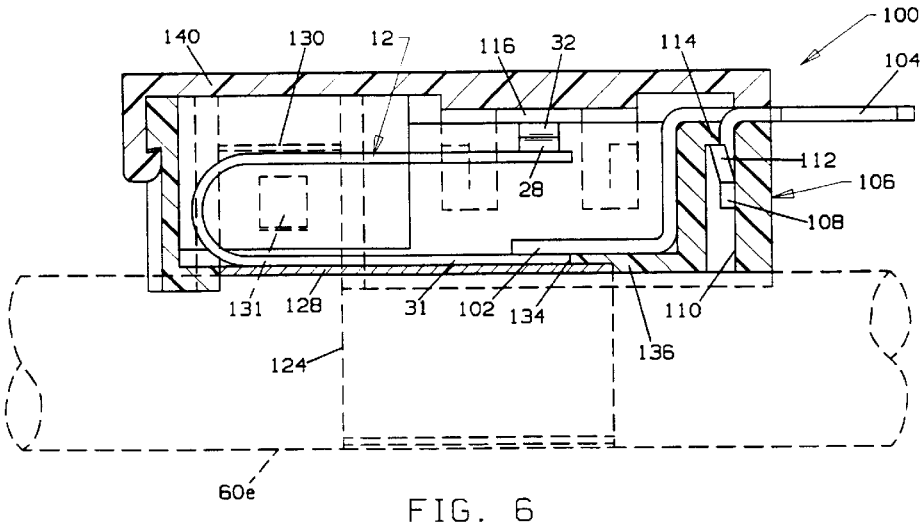
FIG. 6 is a cross sectional view of a modified embodiment similar to the FIG. 3 embodiment.
Figure 7:
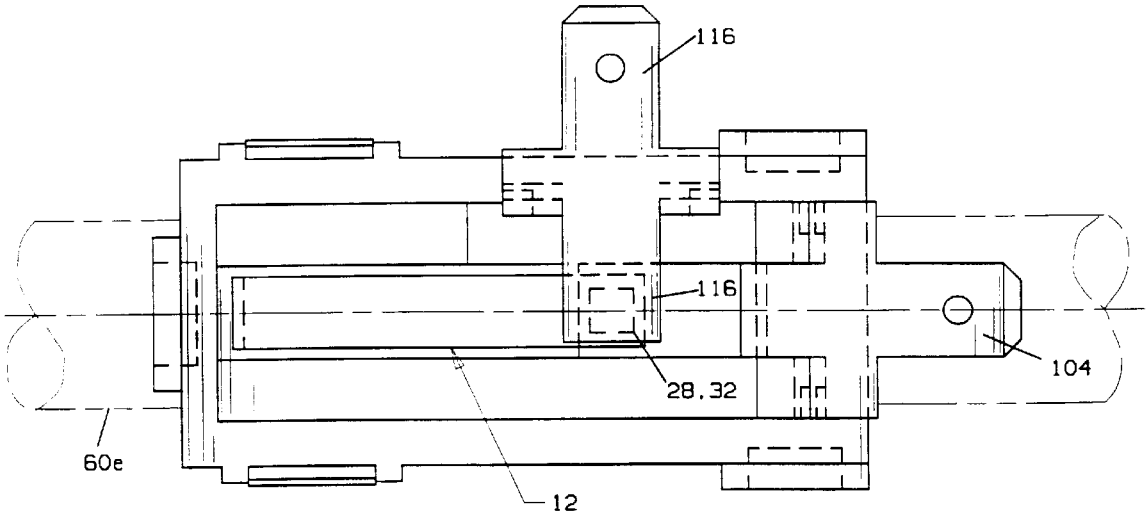
FIG. 7 is a top plan view of the FIG. 6 embodiment with a cover 140 removed for purposes of illustration.
Figure 8:
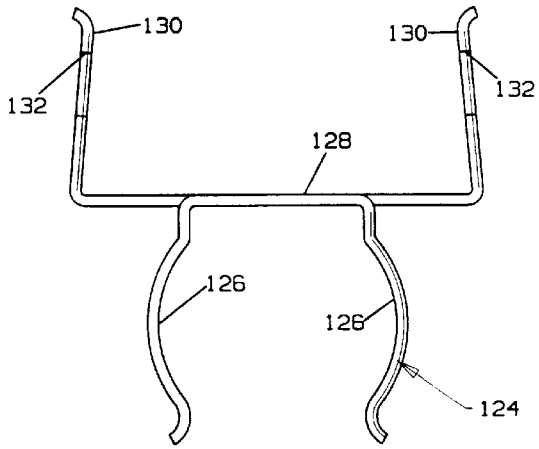
FIG. 8 is a side view of a spring clip used with the FIGS. 6, 7 embodiment.
Figure 9:
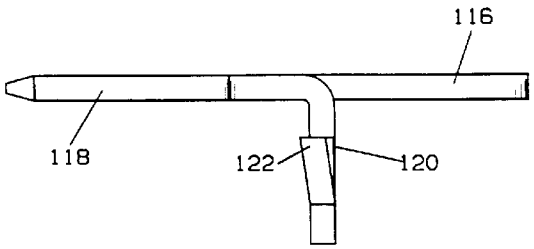
FIG. 9 is a side view of a stationary contact support used in the FIGS. 6, 7 embodiment.

A cover 140 is received over housing 106 as shown in FIG. 6. Due to the arrangement of the components of switch 100, it can be readily assembled using mechanized techniques utilizing motion limited to vertical direction, i.e., an up-down motion as seen in FIG. 6.

The present invention has been described by way of preferred forms of realization. It will be understood, however, that variations and modifications can be made in the same without departing from the scope of the invention.

What is claimed:

1. Thermally actuable electrical switch apparatus to de-energize an electric motor starter electrically connected serially to a start winding of a split-phase motor upon starting of the motor to save power used to run a compressor system comprising an electrically conductive, substantially U-shaped creep type bimetallic element having an outer layer of high expansion material and an inner layer of low expansion material and having first and second ends, an electrically conductive base plate having opposed first and second sides, a stationary contact support surrounding said first and second sides of said base plate with a layer of electrically insulative material interposed between the base plate and the stationary contact support thereby electrically isolating said stationary contact support from the base plate, the stationary contact support mounting a stationary contact, a first end of the bimetallic element being mounted on and electrically connected to the base plate, the second end of the bimetallic element mounting a movable contact on the outer layer aligned with the stationary contact, the movable contact being movable into and out of electrical engagement with the stationary contact upon selected changes in temperature causing deflection of the bimetallic element and means to provide actuation heat to the bimetallic element not requiring electric energy to directly provide such actuation heat comprising a discharge tube of said compressor system, the switch apparatus being mounted in heat transfer relation to the discharge tube, the stationary and movable contacts being serially connected to the solid state electric motor starter.

2. Thermally actuatable electrical switch apparatus according to claim 1 in which a housing having a bottom wall with a cut-out portion formed in the bottom wall, the bimetallic element mounted in the housing with a portion received in the cut-out portion of the bottom wall, a heat conductive clip member having a heat sink plate portion, a pair of tube attaching arms aligned with and spaced from one another extending in a direction away from the plate portion and means to attach the clip member to the housing with the heat sink portion disposed at the cut-out portion of the bottom wall in intimate thermal relation with the bimetallic element.

* * * * *